US006547011B2

(12) United States Patent
Kilgore

(10) Patent No.: US 6,547,011 B2
(45) **Date of Patent: *Apr. 15, 2003**

(54) METHOD AND APPARATUS FOR CONTROLLING FLUID FLOW WITHIN WELLBORE WITH SELECTIVELY SET AND UNSET PACKER ASSEMBLY

(75) Inventor: Marion D. Kilgore, Dallas, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/829,387

(22) Filed: Apr. 9, 2001

(65) Prior Publication Data

US 2001/0018977 A1 Sep. 6, 2001

Related U.S. Application Data

(62) Division of application No. 09/184,770, filed on Nov. 2, 1998, now Pat. No. 6,257,338.

(51) Int. Cl.[7] ..... E21B 33/12; E21B 43/12

(52) U.S. Cl. ..... 166/387; 166/50; 166/65.1; 166/187; 166/313

(58) Field of Search ..... 166/313, 50, 387, 166/65.1, 187, 106

(56) References Cited

U.S. PATENT DOCUMENTS

| | | | | |
|---|---|---|---|---|
| 2,839,142 A | | 6/1958 | Huber | |
| 3,098,524 A | * | 7/1963 | Brown | 166/313 |
| 3,314,479 A | | 4/1967 | McCullough et al. | |
| 3,677,001 A | | 7/1972 | Childers et al. | |
| 3,746,091 A | | 7/1973 | Owen et al. | |
| 3,841,400 A | * | 10/1974 | Callihan et al. | 166/120 |
| 3,926,254 A | | 12/1975 | Evans et al. | |
| 4,095,421 A | | 6/1978 | Silcox | |

(List continued on next page.)

FOREIGN PATENT DOCUMENTS

| | | | | |
|---|---|---|---|---|
| EP | 0 500 341 A1 | | 8/1992 | |
| EP | 554013 | * | 8/1993 | 166/387 X |
| EP | 0 604 155 A1 | | 6/1994 | |
| EP | 0 697 500 A2 | | 2/1996 | |

OTHER PUBLICATIONS

Search Report for European Application No.: EP 99 30 8552.

European Search Report for Application No. EP 99 30 8551.

*Primary Examiner*—Jong-Suk (James) Lee
(74) *Attorney, Agent, or Firm*—J. Richard Konneker

(57) ABSTRACT

Apparatus and corresponding methods are disclosed for controlling fluid flow within a subterranean well. In a described embodiment, a longitudinally spaced apart series of selectively set and unset inflatable packers is utilized to substantially isolate desired portions of a formation intersected by a well. Setting and unsetting of the packers may be accomplished by a variety of devices, some of which may be remotely controllable. Additionally, a series of fluid control devices may be alternated with the packers as part of a tubular string positioned within the well.

12 Claims, 10 Drawing Sheets

U.S. PATENT DOCUMENTS 4,364,587 A 12/1982 Samford
4,375,239 A 3/1983 Barrington et al.
4,378,850 A 4/1983 Barrington
4,424,860 A * 1/1984 McGill ..... 166/187 X
4,457,367 A 7/1984 Brandell
4,458,752 A 7/1984 Brandell
4,491,176 A 1/1985 Reed
4,526,233 A 7/1985 Stout
4,535,843 A 8/1985 Jageler
4,566,535 A * 1/1986 Sanford ..... 166/113
4,636,934 A 1/1987 Schwendemann et al.
4,756,364 A 7/1988 Christensen et al.
4,776,393 A 10/1988 Forehand et al.
4,790,376 A 12/1988 Weeks
4,800,752 A * 1/1989 Piers ..... 166/106 X
4,942,926 A 7/1990 Lessi
4,962,815 A * 10/1990 Schultz et al. ..... 166/387
4,997,041 A 3/1991 Petree
5,062,485 A 11/1991 Wesson et al.
5,070,941 A 12/1991 Kilgore
5,127,477 A 7/1992 Schultz
5,146,983 A 9/1992 Hromas et al.
5,273,113 A 12/1993 Schultz
5,293,937 A 3/1994 Schultz et al.
5,297,634 A 3/1994 Loughlin
5,301,755 A 4/1994 George et al.
5,310,012 A 5/1994 Cendre et al.
5,350,018 A 9/1994 Sorem et al.
5,353,875 A * 10/1994 Schultz et al. ..... 166/297
5,358,035 A 10/1994 Grudzinski
5,467,826 A 11/1995 Miller
5,472,049 A 12/1995 Chaffee et al.
5,474,131 A 12/1995 Jordan, Jr. et al.
5,490,563 A 2/1996 Wesson et al.
5,509,481 A 4/1996 Huber et al.
5,547,029 A 8/1996 Rubbo et al.
5,555,945 A 9/1996 Schultz et al.
5,577,560 A 11/1996 Coronado et al.
5,611,401 A 3/1997 Myers, Jr. et al.
5,692,564 A 12/1997 Brooks
5,704,425 A * 1/1998 Divis et al. ..... 166/191
5,730,219 A 3/1998 Tubel et al.
5,732,776 A 3/1998 Tubel et al.
5,767,400 A 6/1998 Nakano et al.
5,778,982 A 7/1998 Hauck et al.
5,803,167 A 9/1998 Bussear et al.
5,803,186 A 9/1998 Berger et al.
5,823,263 A 10/1998 Morris et al.
5,881,816 A 3/1999 Wright
5,934,371 A 8/1999 Bussear et al.
5,941,307 A 8/1999 Tubel
5,941,313 A 8/1999 Arizmendi
6,039,121 A 3/2000 Kisman
6,056,059 A 5/2000 Ohmer
6,192,982 B1 * 2/2001 Divis et al. ..... 166/187
6,253,857 B1 * 7/2001 Gano ..... 166/374 X
6,427,530 B1 * 8/2002 Kruger et al. ..... 73/152.46

* cited by examiner

METHOD AND APPARATUS FOR CONTROLLING FLUID FLOW WITHIN WELLBORE WITH SELECTIVELY SET AND UNSET PACKER ASSEMBLY

This is a division of application Ser. No. 09/184,770, filed Nov. 2, 1998 now U.S. Pat. No. 6,257,338, such prior application being incorporated by reference herein in its entirety.

BACKGROUND OF THE INVENTION

The present invention relates generally to operations performed within subterranean wells and, in an embodiment described herein, more particularly provides apparatus and methods for controlling fluid flow within a subterranean well.

In horizontal well open hole completions, fluid migration has typically been controlled by positioning a production tubing string within the horizontal wellbore intersecting a formation. An annulus formed between the wellbore and the tubing string is then packed with gravel. A longitudinally spaced apart series of sliding sleeve valves in the tubing string provides fluid communication with selected portions of the formation in relatively close proximity to an open valve, while somewhat restricting fluid communication with portions of the formation at greater distances from an open valve. In this manner, water and gas coning may be reduced in some portions of the formation by closing selected ones of the valves, while not affecting production from other portions of the formation.

Unfortunately, the above method has proved unsatisfactory, inconvenient and inefficient for a variety of reasons. First, the gravel pack in the annulus does not provide sufficient fluid restriction to significantly prevent fluid migration longitudinally through the wellbore. Thus, an open valve in the tubing string may produce a significant volume of fluid from a portion of the formation longitudinally remote from the valve. However, providing additional fluid restriction in the gravel pack in order to prevent fluid migration longitudinally therethrough would also deleteriously affect production of fluid from a portion of the formation opposite an open valve.

Second, it is difficult to achieve a uniform gravel pack in horizontal well completions. In many cases the gravel pack will be less dense and/or contain voids in the upper portion of the annulus. This situation results in a substantially unrestricted longitudinal flow path for migration of fluids in the wellbore.

Third, in those methods which utilize the spaced apart series of sliding sleeve valves, intervention into the well is typically required to open or close selected ones of the valves. Such intervention usually requires commissioning a slickline rig, wireline rig, coiled tubing rig, or other equipment, and is very time-consuming and expensive to perform. Furthermore, well conditions may prevent or hinder these operations.

Therefore, it would be advantageous to provide a method of controlling fluid flow within a subterranean well, which method does not rely on a gravel pack for restricting fluid flow longitudinally through the wellbore. Additionally, it would be advantageous to provide associated apparatus which permits an operator to produce or inject fluid from or into a selected portion of a formation intersected by the well. These methods and apparatus would be useful in open hole, as well as cased hole, completions.

It would also be advantageous to provide a method of controlling fluid flow within a well, which does not require intervention into the well for its performance. Such method would permit remote control of the operation, without the need to kill the well or pass equipment through the wellbore.

SUMMARY OF THE INVENTION

In carrying out the principles of the present invention, in accordance with an embodiment thereof, a method is provided which utilizes selectively set and unset packers to control fluid flow within a subterranean well. The packers may be set or unset with a variety of power sources which may be installed along with the packers, provided at a remote location, or conveyed into the well when it is desired to set or unset selected ones of the packers. Associated apparatus is provided as well.

In broad terms, a method of controlling fluid flow within a subterranean well is provided which includes the step of providing a tubing string including a longitudinally spaced apart series of wellbore sealing devices. The sealing devices are selectively engaged with the wellbore to thereby restrict fluid flow between the tubing string and a corresponding selected portion of a formation intersected by the wellbore.

In one aspect of the present invention, the sealing devices are inflatable packers. The packers may be alternately inflated and deflated to prevent and permit, respectively, fluid flow longitudinally through the wellbore.

In another aspect of the present invention, flow control devices are alternated with the sealing devices along the tubing string to provide selective fluid communication between the tubing string and portions of the formation in relatively close proximity to the flow control devices. Thus, an open flow control device positioned between two sealing devices engaged with the wellbore provides unrestricted fluid communication between the tubing string and the portion of the formation longitudinally between the two sealing devices, but fluid flow from other portions of the formation is substantially restricted.

In yet another aspect of the present invention, the sealing devices and/or flow control devices may be actuated by intervening into the well, or by remote control. If intervention is desired, a fluid source, battery pack, shifting tool, pump, or other equipment may be conveyed into the well by slickline, wireline, coiled tubing, or other conveyance, and utilized to selectively adjust the flow control devices and selectively set or unset the sealing devices. If remote control is desired, the flow control devices and/or sealing devices may be actuated via a form of telemetry, such as mud pulse telemetry, radio waves, other electromagnetic waves, acoustic telemetry, etc. Additionally, the flow control devices and/or sealing devices may be actuated via hydraulic, electric and/or data transmission lines extending to a remote location, such as the earth's surface or another location within the well.

These and other features, advantages, benefits and objects of the present invention will become apparent to one of ordinary skill in the art upon careful consideration of the detailed descriptions of representative embodiments of the invention hereinbelow and the accompanying drawings.

DETAILED DESCRIPTION

Figure 1:
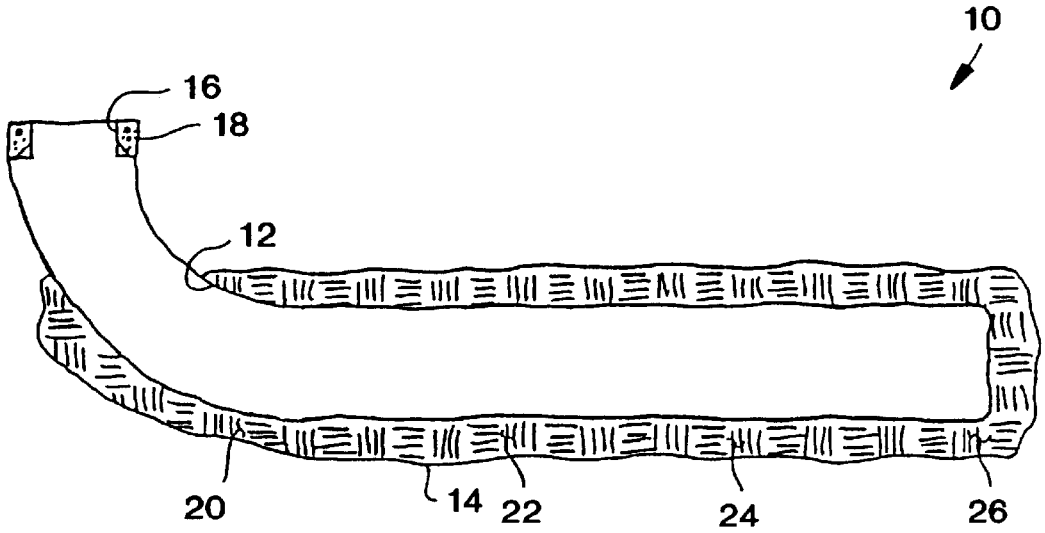
FIG. 1 is a schematicized cross-sectional view of a subterranean well.

Representatively and schematically illustrated in FIG. 1 is a method 10 which embodies principles of the present invention. In the following description of the method 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The method 10 is described herein as it is practiced in an open hole completion of a generally horizontal wellbore portion 12 intersecting a formation 14. However, it is to be clearly understood that methods and apparatus embodying principles of the present invention may be utilized in other environments, such as vertical wellbore portions, cased wellbore portions, etc. Additionally, the method 10 may be performed in wells including both cased and uncased portions, and vertical, inclined and horizontal portions, for example, including the generally vertical portion of the well lined with casing 16 and cement 18. Furthermore, the method 10 is described in terms of producing fluid from the well, but the method may also be utilized in injection operations. As used herein, the term "wellbore" is used to indicate an uncased wellbore (such as wellbore 12 shown in FIG. 1), or the interior bore of the casing or liner (such as the casing 16) if the wellbore has casing or liner installed therein.

It will be readily appreciated by a person of ordinary skill in the art that if the well shown in FIG. 1 is completed in a conventional manner utilizing gravel surrounding a production tubing string including longitudinally spaced apart screens and/or sliding sleeve valves, fluid from various longitudinal portions 20, 22, 24, 26 of the formation 14 will be permitted to migrate longitudinally through the gravel pack in the annular space between the tubing string and the wellbore 12. Of course, a sliding sleeve valve may be closed in an attempt to restrict fluid production from one of the formation portions 20, 22, 24, 26 opposite the valve, but this may have little actual effect, since the fluid may easily migrate longitudinally to another, open, valve in the production tubing string.

Figure 2:
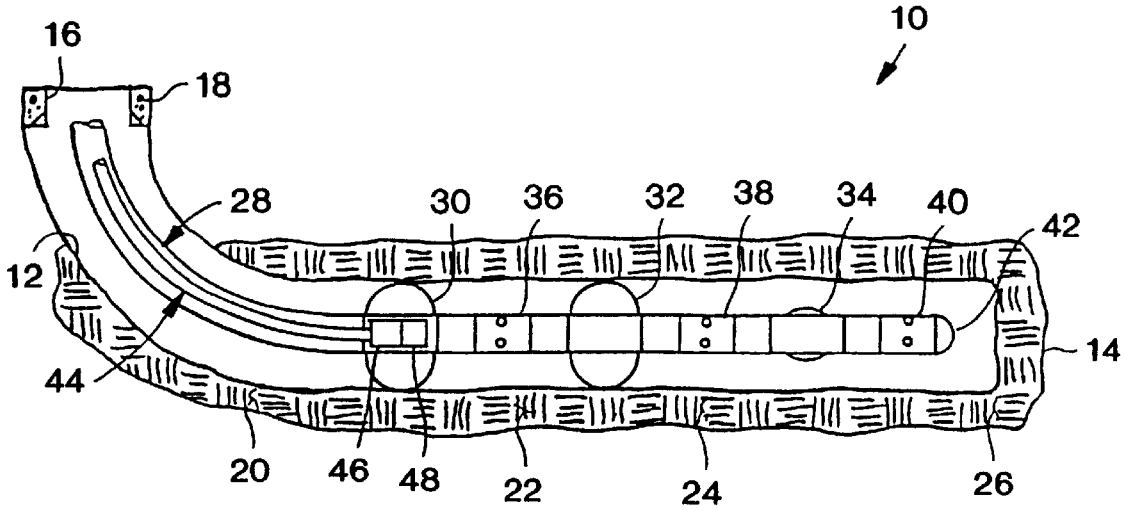
FIG. 2 is a schematicized partially cross-sectional and partially elevational view of the well of FIG. 1, in which steps of a first method embodying principles of the present invention have been performed.

Referring additionally now to FIG. 2, steps of the method 10 have been performed which include positioning a tubing string 28 within the wellbore 12. The tubing string 28 includes a longitudinally spaced apart series of sealing devices 30, 32, 34 and a longitudinally spaced apart series of flow control devices 36, 38, 40. The tubing string 28 extends to the earth's surface, or to another location remote from the wellbore 12, and its distal end is closed by a bull plug 42.

The sealing devices 30, 32, 34 are representatively and schematically illustrated in FIG. 2 as inflatable packers, which are capable of radially outwardly extending to sealingly engage the wellbore 12 upon application of fluid pressure to the packers. Of course, other types of packers, such as production packers settable by pressure, may be utilized for the packers 30, 32, 34, without departing from the principles of the present invention. The packers 30, 32, 34 utilized in the method 10 have been modified somewhat, however, using techniques well within the capabilities of a person of ordinary skill in the art, so that each of the packers is independently inflatable. Thus, as shown in FIG. 2, packers 30 and 32 have been inflated, while packer 34 remains deflated.

In order to inflate a selected one of the packers 30, 32, 34, a fluid power source is conveyed into the tubing string 28, and fluid is flowed into the packer. For example, in FIG. 2 a coiled tubing string 44 has been inserted into the tubing string 28, the coiled tubing string thereby forming a fluid conduit extending to the earth's surface.

At its distal end, the coiled tubing string 44 includes a latching device 46 and a fluid coupling 48. The latching device 46 is of conventional design and is used to positively position the fluid coupling 48 within the selected one of the packers 30, 32, 34. For this purpose, each of the packers 30, 32, 34 includes a conventional internal latching profile (not shown in FIG. 2) formed therein.

The coupling 48 provides fluid communication between the interior of the coiled tubing string 44 and the packer 30, 32, 34 in which it is engaged. Thus, when the coupling 48 is engaged within the packer 30 as shown in FIG. 2, fluid pressure may be applied to the coiled tubing string 44 and communicated to the packer via the coupling 48. Deflation of a previously inflated packer may be accomplished by relieving fluid pressure from within a selected one of the packers 30, 32, 34 via the coupling 48 to the coiled tubing string 44, or to the interior of the tubing string 28, etc. Therefore, it may be clearly seen that each of the packers 30, 32, 34 may be individually and selectively set and unset within the wellbore 12.

The flow control devices 36, 38, 40 are representatively illustrated as sliding sleeve-type valves. However, it is to be understood that other types of flow control devices may be used for the valves 36, 38, 40, without departing from the principles of the present invention. For example, the valves 36, 38, 40 may instead be downhole chokes, pressure operated valves, remotely controllable valves, etc.

Each of the valves 36, 38, 40 may be opened and closed independently and selectively to thereby permit or prevent fluid flow between the wellbore 12 external to the tubing string 28 and the interior of the tubing string. For example, the latching device 46 may be engaged with an internal profile of a selected one of the valves 36, 38, 40 to shift its sleeve to its open or closed position in a conventional manner.

As representatively depicted in FIG. 2, packers 30 and 32 have been inflated and the valve 36 has been closed, thereby preventing fluid migration through the wellbore 12 between the formation portion 22 and the other portions 20, 24, 26 of the formation 14. Note that fluid from the portion 22 may still migrate to the other portions 20, 24, 26 through the formation 14 itself, but such flow through the formation 14 will typically be minimal compared to that which would otherwise be permitted through the wellbore 12. Thus, flow of fluids from the portion 22 to the interior of the tubing string 28 is substantially restricted by the method 10. It will be readily appreciated that production of fluid from selected ones of the other portions 20, 24, 26 may also be substantially restricted by inflating other packers, such as packer 34, and closing other valves, such as valves 38 or 40. Additionally, inflation of the packer 30 may be used to substantially restrict production of fluid from the portion 20, without the need to close a valve.

If, however, it is desired to produce fluid substantially only from the portion 22, the valve 36 may be opened and the other valves 38, 40 may be closed. Thus, the method 10 permits each of the packers 30, 32, 34 to be selectively set or unset, and permits each of the valves 36, 38, 40 to be selectively opened or closed, which enables an operator to tailor production from the formation 14 as conditions warrant. The use of variable chokes in place of the valves 36, 38, 40 allows even further control over production from each of the portions 20, 22, 24, 26.

As shown in FIG. 2, three packers 30, 32, 34 and three valves 36, 38, 40 are used in the method 10 to control production from four portions 20, 22, 24, 26 of the formation 14. It will be readily appreciated that any other number of packers and any number of valves (the number of packers not necessarily being the same as the number of valves) may be used to control production from any number of formation portions, as long as a sufficient number of packers is utilized to prevent flow through the wellbore between each adjacent pair of formation portions. Furthermore, production from additional formations intersected by the wellbore could be controlled by extending the tubing string 28 and providing additional sealing devices and flow control devices therein.

Figure 3:
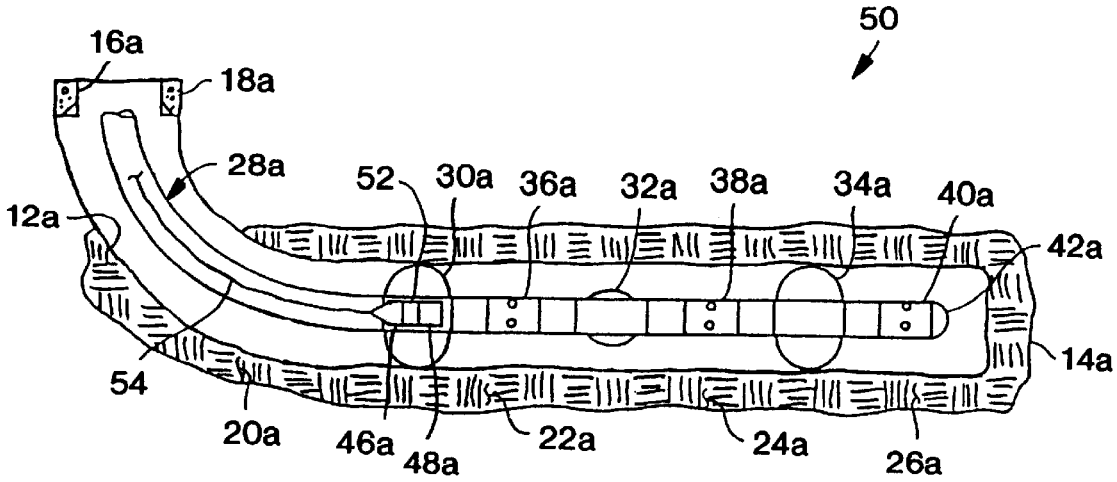
FIG. 3 is a schematicized partially cross-sectional and partially elevational view of the well of FIG. 1, in which steps of a second method embodying principles of the present invention have been performed.

Referring additionally now to FIG. 3, another method 50 is schematically and representatively illustrated. Elements of the method 50 which are similar to those previously described are indicated in FIG. 3 using the same reference numbers, with an added suffix "a".

The method 50 is in many respects similar to the method 10. However, in the method 50, the power source used to inflate the packers 30*a*, 32*a*, 34*a* is a fluid pump 52 conveyed into the tubing string 28*a* attached to a wireline or electric line 54 extending to the earth's surface. The electric line 54 supplies electricity to operate the pump 52, as well as conveying the latching device 46*a*, pump, and coupling 48*a* within the tubing string 28*a*. Other conveyances, such as slickline, coiled tubing, etc., may be used in place of the electric line 54, and electricity may be otherwise supplied to the pump 52, without departing from the principles of the present invention. For example, the pump 52 may include a battery, such as the Downhole Power Unit available from Halliburton Energy Services, Inc. of Duncan, Okla.

As depicted in FIG. 3, the latching device 46*a* is engaged with the packer 30*a*, and the coupling 48*a* is providing fluid communication between the packer and the pump 52. Actuation of the pump 52 causes fluid to be pumped into the packer 30*a*, thereby inflating the packer, so that it sealingly engages the wellbore 12*a*. The packer 34*a* has been previously inflated in a similar manner. Additionally, the valves 36*a*, 38*a* have been closed to restrict fluid flow generally radially therethrough.

Note that the packers 30*a*, 34*a* longitudinally straddle two of the formation portions 22*a*, 24*a*. Thus, it may be seen that fluid flow from multiple formation portions may be restricted in keeping with the principles of the present invention. If desired, another flow control device could be installed in the tubing string 28*a* above the packer 30*a* to selectively permit and prevent fluid flow into the tubing string directly from the formation portion 20*a* while the packer 30*a* is set within the wellbore 12*a*.

Figure 4:
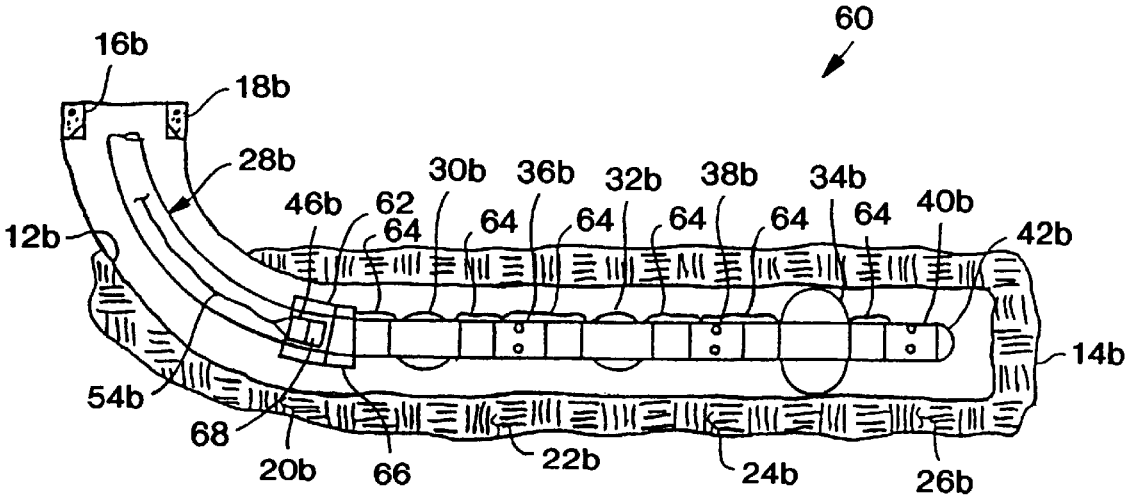
FIG. 4 is a schematicized partially cross-sectional and partially elevational view of the well of FIG. 1, in which steps of a third method embodying principles of the present invention have been performed.

Referring additionally now to FIG. 4, another method 60 embodying principles of the present invention is representatively illustrated. Elements shown in FIG. 4 which are similar to those previously described are indicated using the same reference numbers, with an added suffix "b".

The method 60 is similar in many respects to the method 50, in that the power source used to set selected ones of the packers 30*b*, 32*b*, 34*b* includes the electric line 54*b* and a fluid pump 62. However, in this case the pump 62 is interconnected as a part of the tubing string 28*b*. Thus, the pump 62 is not separately conveyed into the tubing string 28*b*, and is not separately engaged with the selected ones of the packers 30*b*, 32*b*, 34*b* by positioning it therein. Instead, fluid pressure developed by the pump 62 is delivered to selected ones of the packers 30*b*, 32*b*, 34*b* and valves 36*b*, 38*b*, 40*b* via lines 64.

As used herein, the term "pump" includes any means for pressurizing a fluid. For example, the pump 62 could be a motorized rotary or axial pump, a hydraulic accumulator, a device which utilizes a pressure differential between hydrostatic pressure and atmospheric pressure to produce hydraulic pressure, other types of fluid pressurizing devices, etc.

Fluid pressure from the pump 62 is delivered to the lines 64 as directed by a control module 66 interconnected between the pump and lines. Such control modules are well known in the art and may include a plurality of solenoid valves (not shown) for directing the pump fluid pressure to selected ones of the lines 64, in order to actuate corresponding ones of the packers 30*b*, 32*b*, 34*b* and valves 36*b*, 38*b*, 40*b*. For example, if it is desired to inflate the packer 34*b*, the pump 62 is operated to provide fluid pressure to the control module 66, and the control module directs the fluid pressure to an appropriate one of the lines 64 interconnecting the control module to the packer 34*b* by opening a corresponding solenoid valve in the control module.

Electricity to operate the pump 62 is supplied by the electric line 54*b* extending to the earth's surface. The electric line 54*b* is properly positioned by engaging the latching device 46*b* within the pump 62 or control module 66. A wet connect head 68 of the type well known to those of ordinary skill in the art provides an electrical connection between the electric line 54*b* and the pump 62 and control module 66. Alternatively, the electric line 54*b* may be a slickline or coiled tubing, and electric power may be supplied by a battery installed as a part of the tubing string or conveyed separately therein. Of course, if the pump 62 is of a type which does not require electricity for its operation, an electric power source is not needed.

The control module 66 directs the fluid pressure from the pump 62 to selected ones of the lines 64 in response to a signal transmitted thereto via the electric line 54*b* from a remote location, such as the earth's surface. Thus, the electric line 54*b* performs several functions in the method 60: conveying the latching device 46*b* and wet connect head 68 within the tubing string 28*b*, supplying electric power to operate the pump 62, and transmitting signals to the control module 66. Of course, it is not necessary for the electric line 54*b* to perform all of these functions, and these functions may be performed by separate elements, without departing from the principles of the present invention.

Note that the valves 36*b*, 38*b*, 40*b* utilized in the method 60 differ from the valves in the previously described methods 10, 50 in that they are pressure actuated. Pressure actuated valves are well known in the art. They may be of the type that is actuated to a closed or open position upon application of fluid pressure thereto and return to the alternate position upon release of the fluid pressure by a biasing member, such as a spring, they may be of the type that is actuated to a closed or open position only upon application of fluid pressure thereto, or they may be of any other type. Additionally, the valves 36*b*, 38*b*, 40*b* may be chokes in which a resistance to fluid flow generally radially therethrough is varied by varying fluid pressure applied thereto, or by balancing fluid pressures applied thereto. Thus, any type of flow control device may be used for the valves 36*b*, 38*b*, 40*b*, without departing from the principles of the present invention.

In FIG. 4, the packer 34*b* has been set within the wellbore 12*b*, and the valve 40*b* has been closed. The remainder of the valves 36*b*, 38*b* are open. Therefore, fluid flow from the formation portion 26*b* to the interior of the tubing string 28*b* is restricted. It may now be clearly seen that it is not necessary to set more than one of the packers 36*b*, 38*b*, 40*b* in order to restrict fluid flow from a formation portion.

Figure 5:
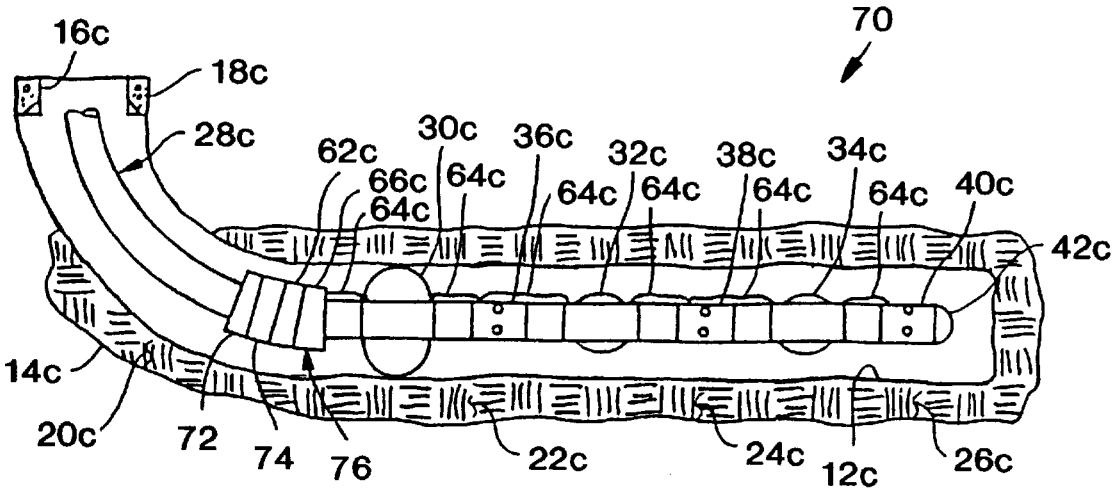
FIG. 5 is a schematicized partially cross-sectional and partially elevational view of the well of FIG. 1, in which steps of a fourth method embodying principles of the present invention have been performed.

Referring additionally now to FIG. 5, another method 70 embodying principles of the present invention is schematically and representatively illustrated. In FIG. 5, elements which are similar to those previously described are indicated using the same reference numbers, with an added suffix "c".

The method 70 is substantially similar to the method 60 described above, except that no intervention into the well is used to selectively set or unset the packers 30*c*, 32*c*, 34*c* or to operate the valves 36*c*, 38*c*, 40*c*. Instead, the pump 62*c* and control module 66*c* are operated by a receiver 72 interconnected in the tubing string 28*c*. Power for operation of the receiver 72, pump 62*c* and control module 66*c* is supplied by a battery 74 also interconnected in the tubing string 28*c*. Of course, other types of power sources may be utilized in place of the battery 74. For example, the power source may be an electro-hydraulic generator, wherein fluid flow is utilized to generate electrical power, etc.

The receiver 72 may be any of a variety of receivers capable of operatively receiving signals transmitted from a remote location. The signals may be in the form of acoustic telemetry, radio waves, mud pulses, electromagnetic waves, or any other form of data transmission.

The receiver 72 is connected to the pump 62*c*, so that when an appropriate signal is received by the receiver, the pump is operated to provide fluid pressure to the control module 66*c*. The receiver 72 is also connected to the control module 66*c*, so that when another appropriate signal is received by the receiver, the control module is operated to direct the fluid pressure via the lines 64*c* to a selected one of the packers 30*c*, 32*c*, 34*c* or valves 36*c*, 38*c*, 40*c*. As such, the combined receiver 72, battery 74, pump 62*c* and control module 66*c* may be referred to as a common actuator 76 for the sealing devices and flow control devices of the tubing string 28*c*.

As shown in FIG. 5, the receiver 72 has received a signal to operate the pump 62*c*, and has received a signal for the control module 66*c* to direct the fluid pressure to the packer 30*c*. The packer 30*c* has, thus, been inflated and is preventing fluid flow longitudinally through the wellbore 12*c* between the formation portions 20*c* and 22*c*.

Figure 6:
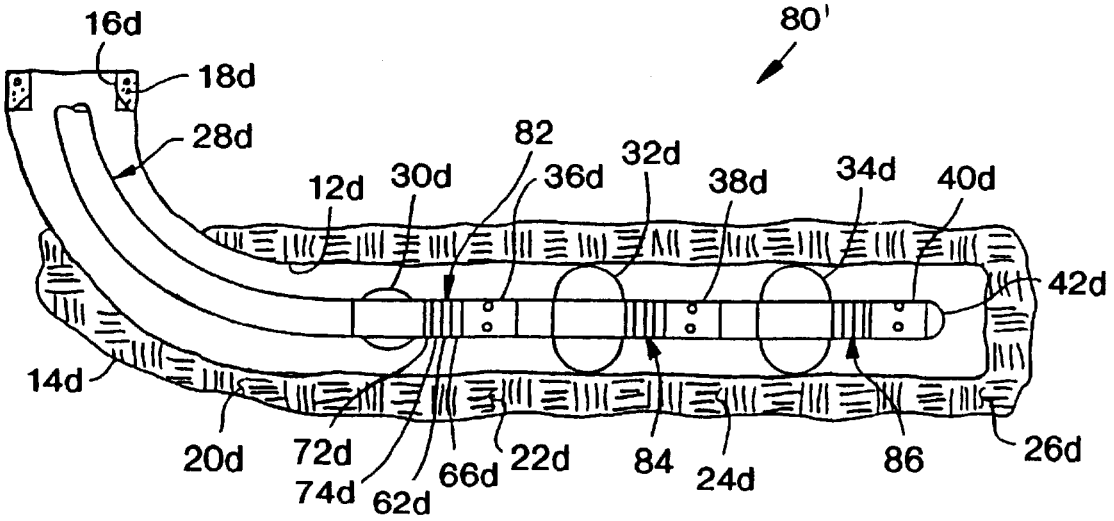
FIG. 6 is a schematicized partially cross-sectional and partially elevational view of the well of FIG. 1, in which steps of a fifth method embodying principles of the present invention have been performed.

Referring additionally now to FIG. 6, another method 80 embodying principles of the present invention is schematically and representatively illustrated. Elements of the method 80 which are similar to those previously described are indicated in FIG. 6 with the same reference numbers, with an added suffix "d".

The method 80 is similar to the previously described method 70. However, instead of a common actuator 76 utilized for selectively actuating the sealing devices and flow control devices, the method 80 utilizes a separate actuator 82, 84, 86 directly connected to a corresponding pair of the packers 30*d*, 32*d*, 34*d* and valves 36*d*, 38*d*, 40*d*. In other words, each of the actuators 82, 84, 86 is interconnected to one of the packers 30*d*, 32*d*, 34*d*, and to one of the valves 36*d*, 38*d*, 40*d*.

Each of the actuators 82, 84, 86 is a combination of a receiver 72*d*, battery 74*d*, pump 62*d* and control module 66*d*. Since each actuator 82, 84, 86 is directly connected to its corresponding pair of the packers 30*d*, 32*d*, 34*d* and valves 36*d*, 38*d*, 40*d*, no lines (such as lines 64*c*, see FIG. 6) are used to interconnect the control modules 66*d* to their respective packers and valves. However, lines could be provided if it were desired to space one or more of the actuators 82, 84, 86 apart from its corresponding pair of the packers and valves. Additionally, it is not necessary for each actuator 82, 84, 86 to be connected to a pair of the packers and valves, for example, a separate actuator could be utilized for each packer and for each valve, or for any combination thereof, in keeping with the principles of the present invention.

In FIG. 6, the receiver 72*d* of the actuator 84 has received a signal to operate its pump 62*d*, and a signal for its control module 66*d* to direct the fluid pressure developed by the pump to the packer 32*d*, and then to direct the fluid pressure to the valve 38*d*. The packer 32*d* is, thus sealingly engaging the wellbore 12*d* between the formation portions 22*d* and 24*d*. Additionally, the receiver 72*d* of the actuator 86 has received a signal to operate its pump 62*d*, and a signal for its control module 66*d* to direct the fluid pressure to the packer 34*d*. Therefore, the packer 34*d* is sealingly engaging the wellbore 12*d* between the formation portions 24*d* and 26*d*, and fluid flow is substantially restricted from the formation portion 24*d* to the interior of the tubing string 28*d*.

Figure 7:
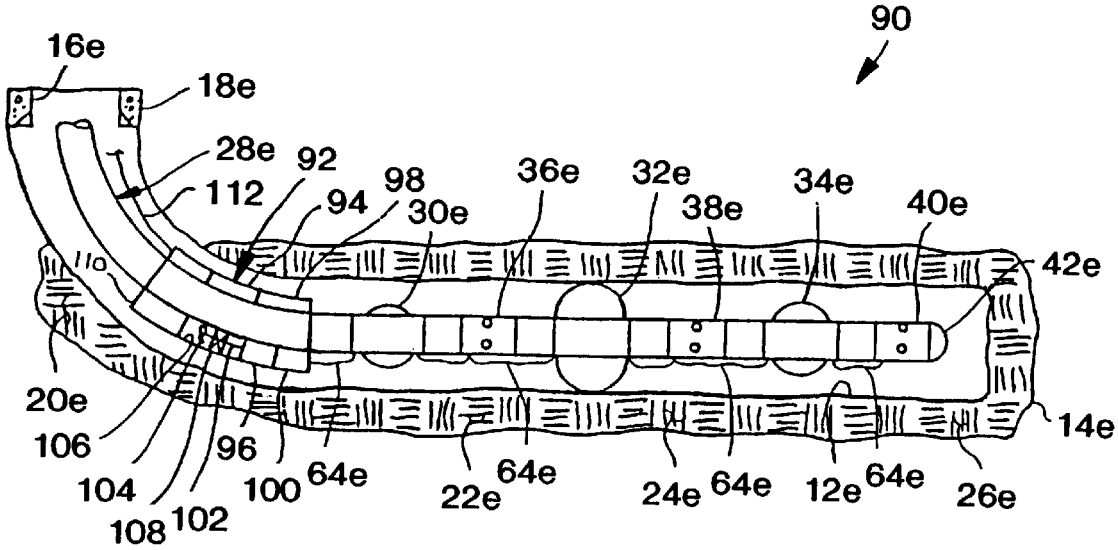
FIG. 7 is a schematicized partially cross-sectional and partially elevational view of the well of FIG. 1, in which steps of a sixth method embodying principles of the present invention have been performed.

Referring additionally now to FIG. 7, another method 90 embodying principles of the present invention is schematically and representatively illustrated. Elements shown in FIG. 7 which are similar to those previously described are indicated using the same reference numbers, with an added suffix "e".

The method 90 is similar to the method 70 shown in FIG. 5, in that a single actuator 92 is utilized to selectively actuate the packers 30*e*, 32*e*, 34*e* and valves 36*e*, 38*e*, 40*e*. However, the actuator 92 relies only indirectly on a battery 94 for operation of its fluid pump 96, thus greatly extending the useful life of the battery. A receiver 98 and control module 100 of the actuator 92 are connected to the battery 94 for operation thereof.

The pump 96 is connected via a shaft 102 to an impeller 104 disposed within a fluid passage 106 formed internally in the actuator 92. A solenoid valve 108 is interconnected to the fluid passage 106 and serves to selectively permit and prevent fluid flow from the wellbore 12*e* into an atmospheric gas chamber 110 of the actuator through the fluid passage. Thus, when the valve 108 is opened, fluid flowing from the wellbore 12*e* through the fluid passage 106 into the chamber 110 causes the impeller 104 and shaft 102 to rotate, thereby operating the pump 96. When the valve 108 is closed, the pump 96 ceases to operate.

The valve 108 and control module 100 are operated in response to signals received by the receiver 98. As shown in FIG. 7, the receiver 98 has received a signal to operate the pump 96, and the valve 108 has been opened accordingly. The receiver 98 has also received a signal to operate the control module 100 to direct fluid pressure developed by the pump 96 via the lines 64*e* to the packer 32*e* and then to the valve 36*e*. In this manner, the packer 32*e* has been inflated to sealingly engage the wellbore 12*e* and the valve 36*e* has been closed. Thus, it may be readily appreciated that fluid flow from multiple formation portions 20*e* and 22*e* into the tubing string 28*e* has been substantially restricted, even though only one of the packers 30*e*, 32*e*, 34*e* has been inflated.

Of course, many other types of actuators may be used in place of the actuator 92 shown in FIG. 7. The actuator 92 has been described only as an example of the variety of actuators that may be utilized for operation of the packers 30*e*, 32*e*, 34*e* and valves 36*e*, 38*e*, 40*e*. For example, an actuator of the type disclosed in U.S. Pat. No. 5,127,477 to Schultz may be used in place of the actuator 92. Additionally, the actuator 92 may be modified extensively without departing from the principles of the present invention. For example, the battery 94 and receiver 98 may be eliminated by running a control line 112 from a remote location, such as the earth's surface or another location in the well, to the actuator 92. The control line 112 may be connected to the valve 108 and control module 100 for transmitting signals thereto, supplying electrical power, etc. Furthermore, the chamber 110, impeller 104 and valve 108 may be eliminated by delivering power directly from the control line 112 to the pump 100 for operation thereof.

Figure 8:
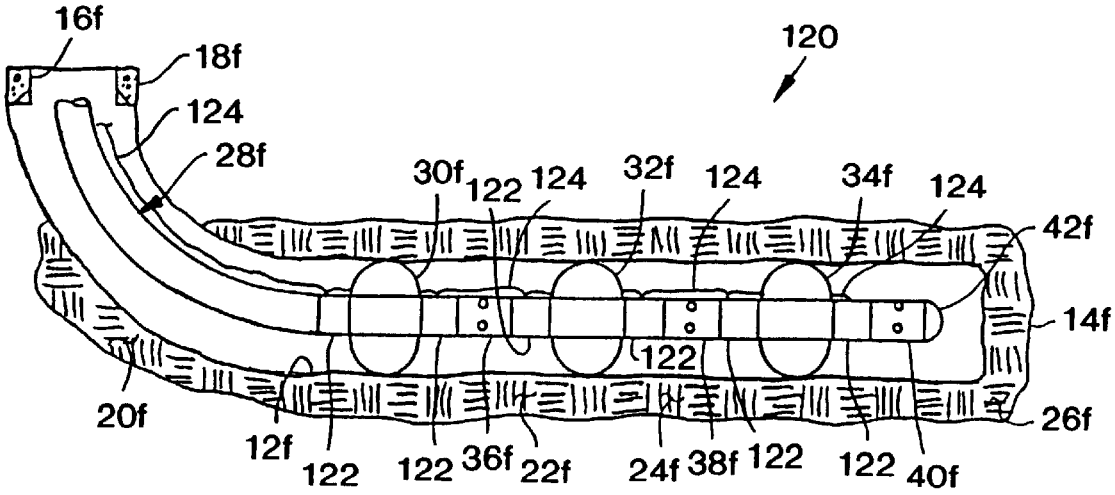
FIG. 8 is a schematicized partially cross-sectional and partially elevational view of the well of FIG. 1, in which steps of a seventh method embodying principles of the present invention have been performed.

Referring additionally now to FIG. 8, another method 120 embodying principles of the present invention is schematically and representatively illustrated. In FIG. 8, elements which are similar to those previously described are indicated using the same reference numbers, with an added suffix "f".

In the method 120, each packer 30*f*, 32*f*, 34*f* and each valve 36*f*, 38*f*, 40*f* has a corresponding control module 122 connected thereto. The control modules 122 are of the type utilized to direct fluid pressure from lines 124 extending to a remote location to actuate equipment to which the control modules are connected. For example, the control modules 122 may be SCRAMS modules available from Petroleum Engineering Services of The Woodlands, Tex., and/or as described in U.S. Pat. No. 5,547,029. Accordingly, the lines 124 also carry electrical power and transmit signals to the control modules 122 for selective operation thereof. For example, the lines 124 may transmit a signal to the control module 122 connected to the packer 30*f*, causing the control module to direct fluid pressure from the lines to the packer 30*f*, thereby inflating the packer 30*f*. Alternatively, one control module may be connected to more than one of the packers 30*f*, 32*f*, 34*f* and valves 36*f*, 38*f*, 40*f* in a manner similar to that described in U.S. Pat. No. 4,636,934.

Figure 9:
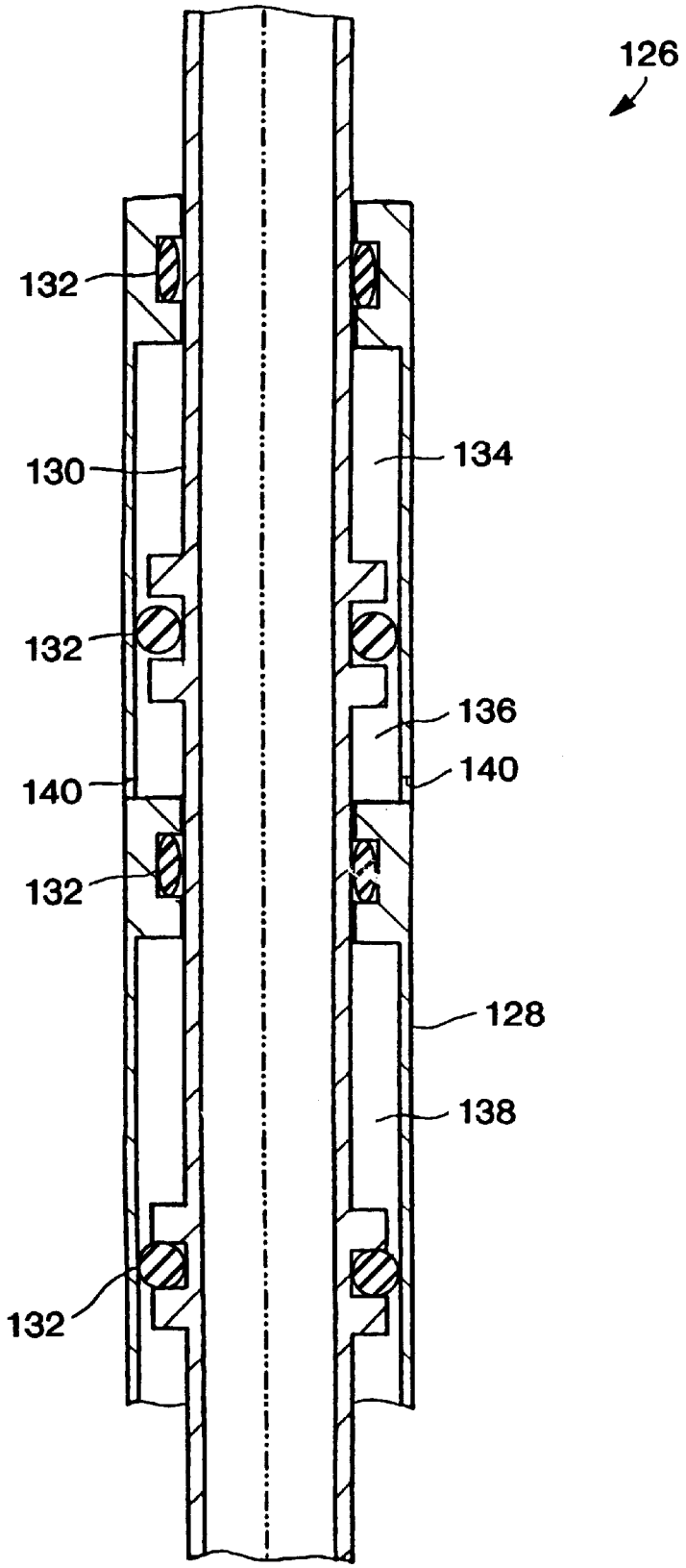
FIG. 9 is a schematicized cross-sectional view of a first apparatus embodying principles of the present invention.

Referring additionally now to FIG. 9, an actuator 126 embodying principles of the present invention is representatively illustrated. The actuator 126 may be used to actuate any of the tools described above, such as packers 30, 32, 34, valves 36, 38, 40, flow chokes, etc. In particular, the actuator 126 may be utilized where it is desired to have an individual actuator actuate a corresponding individual tool, such as in the method 80 described above.

The actuator 126 includes a generally tubular outer housing 128, a generally tubular inner mandrel 130 and circumferential seals 132. The seals 132 sealingly engage both the outer housing 128 and the inner mandrel, and divide the annular space therebetween into three annular chambers 134, 136, 138. Each of chambers 134 and 138 initially has a gas, such as air or Nitrogen, contained therein at atmospheric pressure or another relatively low pressure. Hydrostatic pressure within a well is permitted to enter the chamber 136 via openings 140 formed through the housing 128.

It will be readily appreciated by one skilled in the art that, with hydrostatic pressure greater than atmospheric pressure in chamber 136 and surrounding the exterior of the actuator 126, the outer housing 128 will be biased downwardly relative to the mandrel 130. Such biasing force may be utilized to actuate a tool, for example, a packer, valve or choke, connected to the actuator 126. For example, a mandrel of a conventional packer which is set by applying a downwardly directed force to the packer mandrel may be connected to the housing 128 so that, when the housing is downwardly displaced relative to the inner mandrel 130 by the downwardly biasing force, the packer will be set. Similarly, the actuator 126 may be connected to a valve, for example, to displace a sleeve or other closure element of the valve, and thereby open or close the valve. Note that either the housing 128 or the mandrel 130, or both of them, may be interconnected in a tubular string for conveying the actuator 126 in the well, and either the housing or the mandrel, or both of them, may be attached to the tool for actuation thereof. Of course, the actuator 126 may be otherwise conveyed, for example, by slickline, etc., without departing from the principles of the present invention.

Figure 10:
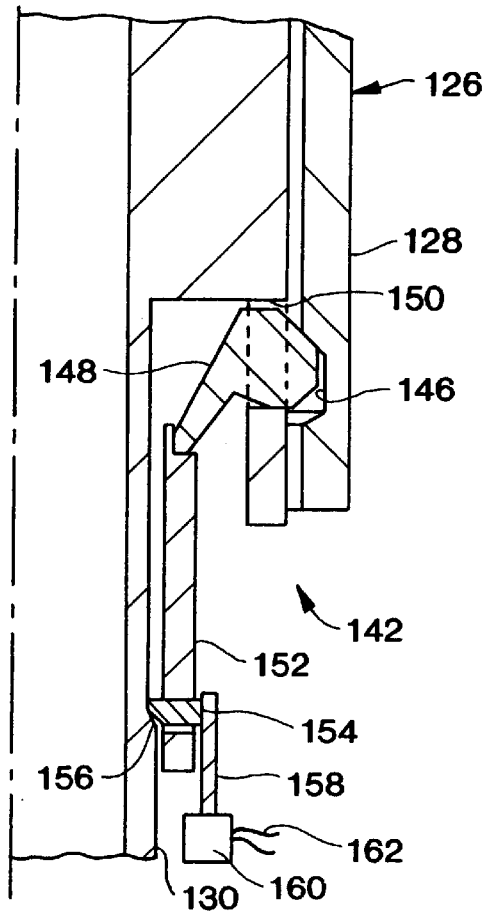
FIG. 10 is a schematicized quarter-sectional view of a first release device embodying principles of the present invention which may be used with the first apparatus.
Figure 11:
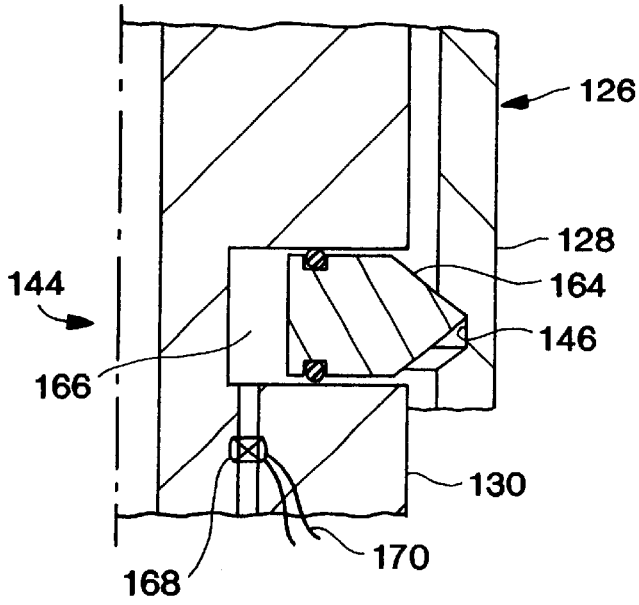
FIG. 11 is a schematicized quarter-sectional view of a second release device embodying principles of the present invention which may be used with the first apparatus.

Referring additionally now to FIGS. 10 and 11, devices 142, 144 for releasing the housing 128 and mandrel 130 for relative displacement therebetween are representatively illustrated. Each of the devices 142, 144 permits the actuator 126 to be lowered into a well with increasing hydrostatic pressure, without the housing 128 displacing relative to the mandrel 130, until the device is triggered, at which time the housing and mandrel are released for displacement relative to one another.

In FIG. 10, it may be seen that an annular recess 146 is formed internally on the housing 128. A tumbler or stop member 148 extends outward through an opening 150 formed in the mandrel 130 and into the recess 146. In this position, the tumbler 148 prevents downward displacement of the housing 128 relative to the mandrel 130. The tumbler 148 is maintained in this position by a retainer member 152.

A detent pin or lug 154 engages an external shoulder 156 formed on the mandrel 130 and prevents displacement of the retainer 152 relative to the tumbler 148. An outer release sleeve or blocking member 158 prevents disengagement of the detent pin 154 from the shoulder 156. A solenoid 160 permits the release sleeve 158 to be displaced, so that the detent pin 154 is released, the retainer is permitted to displace relative to the tumbler 148, and the tumbler is permitted to disengage from the recess 146, thereby releasing the housing 128 for displacement relative to the mandrel 130.

The solenoid 160 is activated to displace the release sleeve 158 in response to a signal received by a receiver, such as receivers 72, 98 described above. For this purpose, lines 162 may be interconnected to a receiver and battery as described above for the actuator 76 in the methods 70, 80, or for the actuator 92 in the method 90. Alternatively, electrical power may be supplied to the lines 162 via a wet connect head, such as the wet connect head 68 in the method 60.

In FIG. 11, it may be seen that the recess 146 is engaged by a piston 164 extending outwardly from a fluid-filled chamber 166 formed in the mandrel 130. Fluid in the chamber 166 prevents the piston 164 from displacing inwardly out of engagement with the recess 146. A valve 168 selectively permits fluid to be vented from the chamber 166, thereby permitting the piston 164 to disengage from the recess, and permitting the housing 128 to displace relative to the mandrel 130.

The valve 168 may be a solenoid valve or other type of valve which permits fluid to flow therethrough in response to an electrical signal on lines 170. Thus, the valve 168 may be interconnected to a receiver and/or battery in a manner similar to the solenoid 160 described above. The valve 168 may be remotely actuated by transmission of a signal to a receiver connected thereto, or the valve may be directly actuated by coupling an electrical power source to the lines 170. Of course, other manners of venting fluid from the chamber 166 may be utilized without departing from the principles of the present invention.

Figure 12:
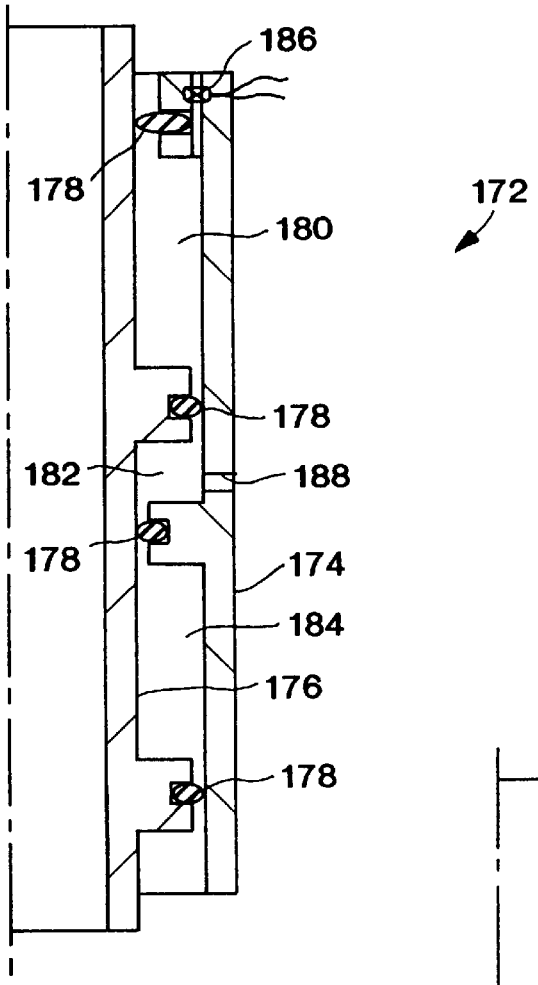
FIG. 12 is a schematicized quarter-sectional view of a second apparatus embodying principles of the present invention.

Referring additionally now to FIG. 12, another actuator 172 embodying principles of the present invention is representatively illustrated. The actuator 172 includes a generally tubular outer housing 174 and a generally tubular inner mandrel 176. Circumferential seals 178 sealingly engage the housing 174 and mandrel 176, isolating annular chambers 180, 182, 184 formed between the housing and mandrel.

Chamber 180 is substantially filled with a fluid, such as oil. A valve 186, similar to valve 168 described above, permits the fluid to be selectively vented from the chamber 180 to the exterior of the actuator 172. When the valve 186 is closed, the housing 174 is prevented from displacing downward relative to the mandrel 176. However, when the valve 186 is opened, such as by using any of the methods described above for opening the valve 168, the fluid is permitted to flow out of the chamber 180 and the housing 174 is permitted to displace downwardly relative to the mandrel 176.

The housing 174 is biased downwardly due to a difference in pressure between the chambers 182, 184. The chamber 182 is exposed to hydrostatic pressure via an opening 188 formed through the housing 174. The chamber 184 contains a gas, such as air or Nitrogen at atmospheric or another relatively low pressure. Thus, when the valve 186 is opened, hydrostatic pressure in the chamber 182 displaces the housing 174 downward relative to the mandrel 176, with the fluid in the chamber 180 being vented to the exterior of the actuator 172.

Figure 13:
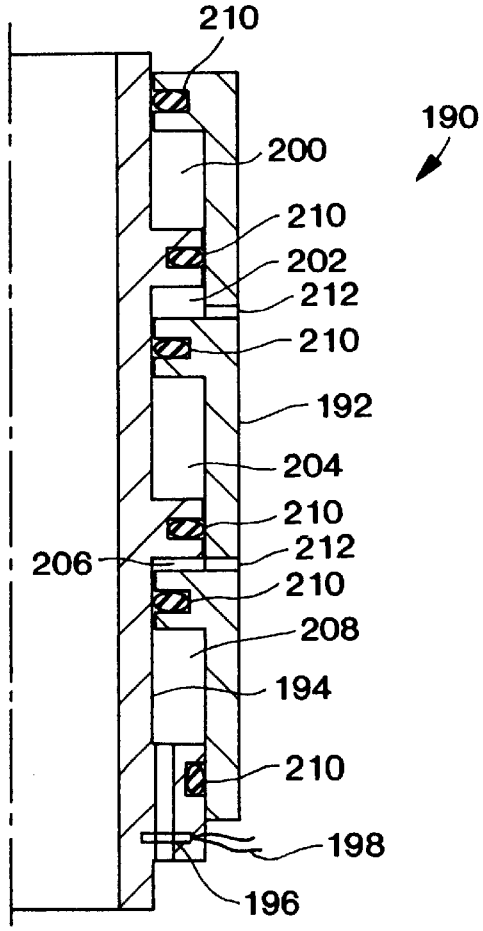
FIG. 13 is a schematicized quarter-sectional view of a third apparatus embodying principles of the present invention.

Referring additionally now to FIG. 13, another actuator 190 embodying principles of the present invention is representatively illustrated. The actuator 190 is similar in many respects to the previously described actuator 172. However, the actuator 190 has additional chambers for increasing its force output, and includes a combined valve and choke 196 for regulating the rate at which its housing 192 displaces relative to its mandrel 194.

The valve and choke 196 may be a combination of a solenoid valve, such as valves 168, 186 described above, and an orifice or other choke member, or it may be a variable choke having the capability of preventing fluid flow therethrough or of metering such fluid flow. If the valve and choke 196 includes a variable choke, the rate at which fluid is metered therethrough may be adjusted by correspondingly adjusting an electrical signal applied to lines 198 connected thereto.

Annular chambers 200, 202, 204, 206, 208 are formed between the housing 192 and the mandrel 194. The chambers 200, 202, 204, 206, 208 are isolated from each other by circumferential seals 210. The chambers 202, 206 are exposed to hydrostatic pressure via openings 212 formed through the housing 192. The chambers 200, 204 contain a gas, such as air or Nitrogen at atmospheric or another relatively low pressure. The use of multiple sets of chambers permits a larger force to be generated by the actuator 190 in a given annular space.

A fluid, such as oil, is contained in the chamber 208. The valve/choke 196 regulates venting of the fluid from the chamber 208 to the exterior of the actuator 190. When the valve/choke 196 is opened, the fluid in the chamber 208 is permitted to escape therefrom, thereby permitting the housing 192 to displace relative to the mandrel 194. A larger or smaller orifice may be selected to correspondingly increase or decrease the rate at which the housing 192 displaces relative to the mandrel 194 when the fluid is vented from the chamber 208, or the electrical signal on the lines 198 may be adjusted to correspondingly vary the rate of fluid flow through the valve/choke 196 if it includes a variable choke.

Figure 14:
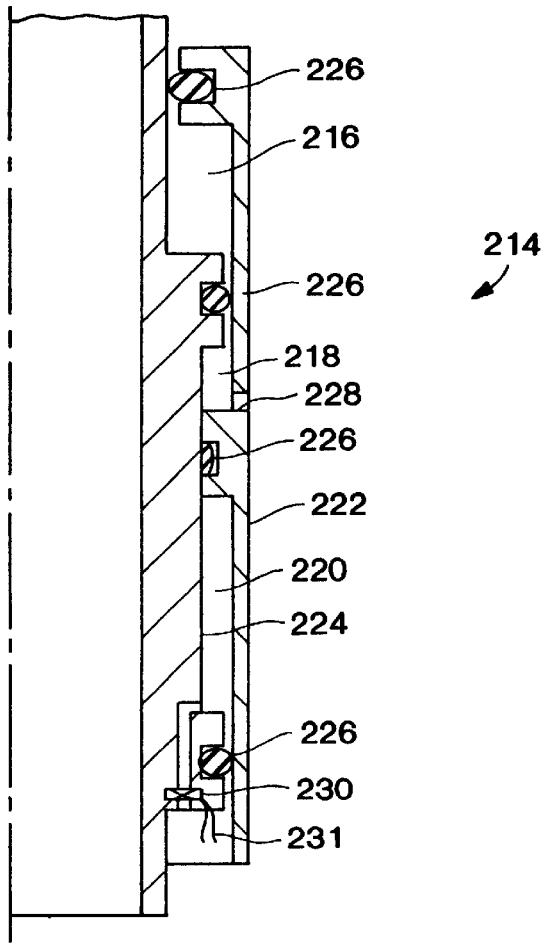
FIG. 14 is a schematicized quarter-sectional view of a fourth apparatus embodying principles of the present invention.

Referring additionally now to FIG. 14, another actuator 214 embodying principles of the present invention is representatively illustrated. The actuator 214 is similar in many respects to the actuator 172 described above. However, the actuator 214 utilizes an increased piston area associated with its annular gas chamber 216 in order to increase the force output by the actuator.

The actuator 214 includes the chamber 216 and annular chambers 218, 220 formed between an outer generally tubular housing 222 and an inner generally tubular mandrel 224. Circumferential seals 226 sealingly engage the mandrel 224 and the housing 222. The chamber 216 contains gas, such as air or Nitrogen, at atmospheric or another relatively low pressure, the chamber 218 is exposed to hydrostatic pressure via an opening 228 formed through the housing 222, and the chamber 220 contains a fluid, such as oil.

A valve 230 selectively permits venting of the fluid in the chamber 220 to the exterior of the actuator 214. The housing 222 is prevented by the fluid in the chamber 220 from displacing relative to the mandrel 224. When the valve 230 is opened, for example, by applying an appropriate electrical signal to lines 231, the fluid in the chamber 220 is vented, thereby permitting the housing 222 to displace relative to the mandrel 224.

Note that each of the actuators 126, 172, 190, 214 has been described above as if the housing and/or mandrel thereof is connected to the packer, valve, choke, tool, item of equipment, flow control device, etc. which is desired to be actuated. However, it is to be clearly understood that each of the actuators 126, 172, 190, 214 may be otherwise connected or attached to the tool(s) or item(s) of equipment, without departing from the principles of the present invention. For example, the output of each of valves 168, 186, 196, 230 may be connected to any hydraulically actuated tool(s) or item(s) of equipment for actuation thereof. In this manner, each of the actuators 126, 172, 190, 214 may serve as the actuator or fluid power source in the methods 50, 60, 70, 80, 120.

Figure 15:
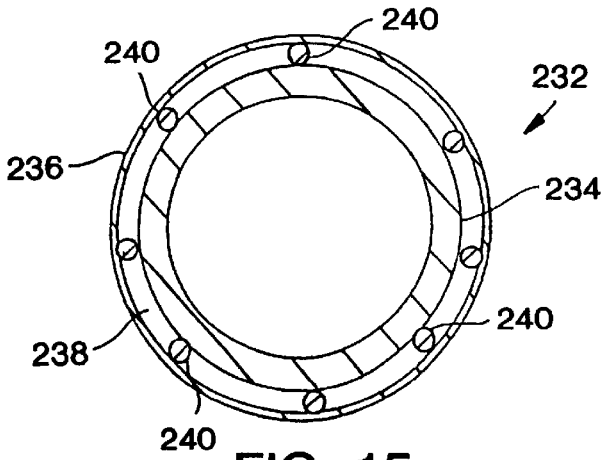
FIG. 15 is a cross-sectional view of an atmospheric chamber embodying principles of the present invention.

Referring additionally now to FIG. 15, a container 232 embodying principles of the present invention is representatively illustrated. The container 232 may be utilized to store a gas at atmospheric or another relatively low pressure downhole. In an embodiment described below, the container 232 is utilized in the actuation of one or more tools or items of equipment downhole.

The container 232 includes a generally tubular inner housing 234 and a generally tubular outer housing 236. An annular chamber 238 is formed between the inner and outer housings 234, 236. In use, the annular chamber 238 contains a gas, such as air or Nitrogen, at atmospheric or another relatively low pressure.

It will be readily appreciated by one skilled in the art that, in a well, hydrostatic pressure will tend to collapse the outer housing 236 and burst the inner housing 234, due to the differential between the pressure in the annular chamber 238 and the pressure external to the container 232 (within the inner housing 234 and outside the outer housing 236). For this reason, the container 232 includes a series of circumferentially spaced apart and longitudinally extending ribs or rods 240. Preferably, the ribs 240 are spaced equidistant from each other, but that is not necessary, as shown in FIG. 15.

The ribs 240 significantly increase the ability of the outer housing 236 to resist collapse due to pressure applied externally thereto. The ribs 240 contact both the outer housing 236 and the inner housing 234, so that radially inwardly directed displacement of the outer housing 236 is resisted by the inner housing 234. Thus, the container 232 is well suited for use in high pressure downhole environments.

Figure 16:
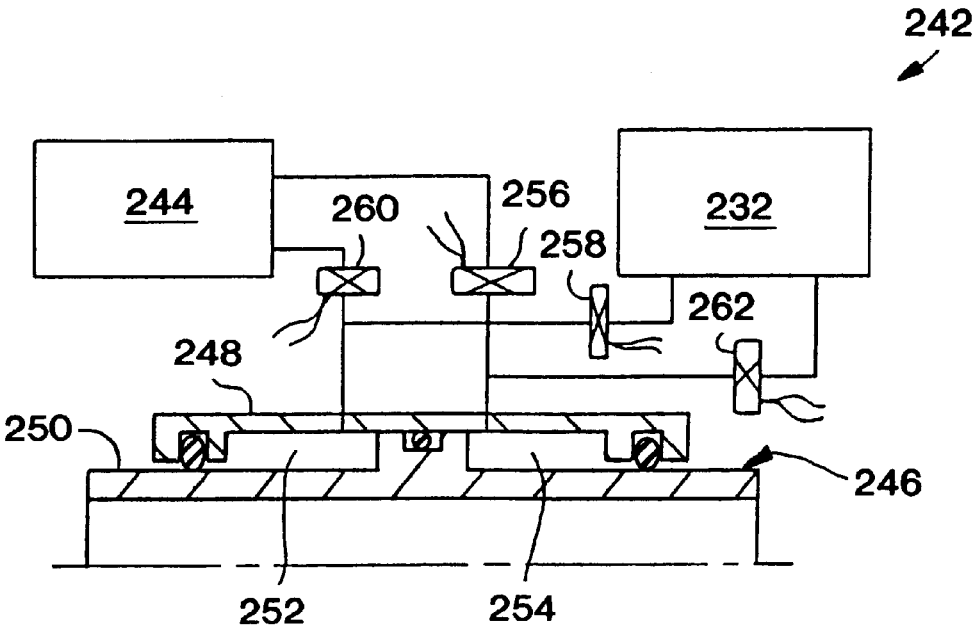
FIG. 16 is a schematicized view of a fifth apparatus embodying principles of the present invention.

Referring additionally now to FIG. 16, an apparatus 242 embodying principles of the present invention is representatively illustrated. The apparatus 242 demonstrates use of the container 232 along with a fluid power source 244, such as any of the pumps and/or actuators described above which are capable of producing an elevated fluid pressure, to control actuation of a tool 246.

The tool 246 is representatively illustrated as including a generally tubular outer housing 248 sealingly engaged and reciprocably disposed relative to a generally tubular inner mandrel 250. Annular chambers 252, 254 are formed between the housing 248 and mandrel 250. Fluid pressure in the chamber 252 greater than fluid pressure in the chamber 254 will displace the housing 248 to the left relative to the mandrel 250 as viewed in FIG. 16, and fluid pressure in the chamber 254 greater than fluid pressure in the chamber 252 will displace the housing 248 to the right relative to the mandrel 250 as viewed in FIG. 16. Of course, either or both of the housing 248 and mandrel 250 may displace in actual practice. It is to be clearly understood that the tool 246 is merely representative of tools, such as packers, valves, chokes, etc., which may be operated by fluid pressure applied thereto.

When it is desired to displace the housing 248 and/or mandrel 250, one of the chambers 252, 254 is vented to the container 232, and the other chamber is opened to the fluid power source 244. For example, to displace the housing 248 to the right relative to the mandrel 250 as viewed in FIG. 16, a valve 256 between the fluid power source 244 and the chamber 254 is opened, and a valve 258 between the container 232 and the chamber 252 is opened. The resulting pressure differential between the chambers 252, 254 causes the housing 248 to displace to the right relative to the mandrel 250. To displace the housing 248 to the left relative to the mandrel 250 as viewed in FIG. 16, a valve 260 between the fluid power source 244 and the chamber 252 is opened, and a valve 262 between the container 232 and the chamber 254 is opened. The valves 260, 262 are closed when the housing 248 is displaced to the right relative to the mandrel, and the valves 256, 258 are closed when the housing is displaced to the left relative to the mandrel. The tool 246 may, thus, be repeatedly actuated by alternately connecting each of the chambers 252, 254 to the fluid power source 244 and the container 232.

The valves 256, 258, 260, 262 are representatively illustrated in FIG. 16 as being separate electrically actuated valves, but it is to be understood that any type of valves may be utilized without departing from the principles of the present invention. For example, the valves 256, 258, 260, 262 may be replaced by two appropriately configured conventional two-way valves, etc.

The tool 246 may be used to actuate another tool, without departing from the principles of the present invention. For example, the mandrel 250 may be attached to a packer mandrel, so that when the mandrel 250 is displaced in one direction relative to the housing 248, the packer is set, and when the mandrel 250 is displaced in the other direction relative to the housing 248, the packer is unset. For this purpose, the housing 248 or mandrel 250 may be interconnected in a tubular string for conveyance within a well.

Note that the fluid power source 244 may alternatively be another source of fluid at a pressure greater than that of the gas or other fluid in the container 232, without the pressure of the delivered fluid being elevated substantially above hydrostatic pressure in the well. For example, element 244 shown in FIG. 16 may be a source of fluid at hydrostatic pressure. The fluid source 244 may be the well annulus surrounding the apparatus 242 when it is disposed in the well; it may be the interior of a tubular string to which the apparatus is attached; it may originate in a chamber conveyed into the well with, or separate from, the apparatus; if conveyed into the well in a chamber, the chamber may be a collapsible or elastic bag, or the chamber may include an equalizing piston separating clean fluid for delivery to the tool 246 from fluid in the well; the fluid source may include fluid processing features, such as a fluid filter, etc. Thus, it will be readily appreciated that it is not necessary for the fluid source 244 to deliver fluid to the tool 246 at a pressure having any particular relationship to hydrostatic pressure in the well, although the fluid source may deliver fluid at greater than, less than and/or equal to hydrostatic pressure.

Figure 17:
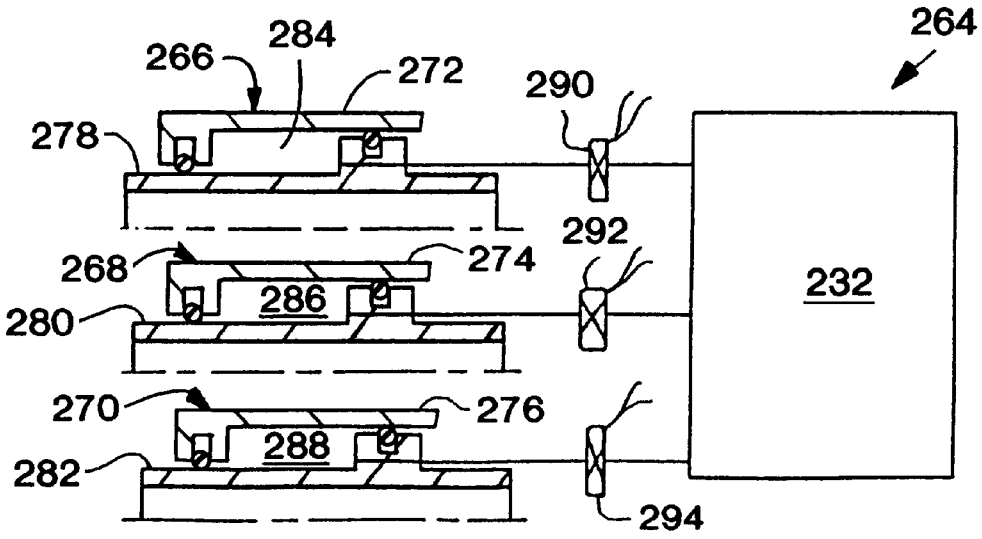
FIG. 17 is a schematicized view of a sixth apparatus embodying principles of the present invention.

Referring additionally to FIG. 17, another apparatus 264 utilizing the container 232 and embodying principles of the present invention is representatively illustrated. The apparatus 264 includes multiple tools 266, 268, 270 having generally tubular outer housings 272, 274, 276 sealingly engaged with generally tubular inner mandrels 278, 280, 282, thereby forming annular chambers 284, 286, 288 therebetween, respectively. The tools 266, 268, 270 are merely representative of the wide variety of packers, valves, chokes, and other flow control devices, items of equipment and tools which may be actuated using the apparatus 264. Alternatively, displacement of each of the housings 272, 274, 276 relative to corresponding ones of the mandrels 278, 280, 282 may be utilized to actuate associated flow control devices, items of equipment and tools attached thereto. For example, the apparatus 264 including the container 232 and the tool 266 may be interconnected in a tubular string, with the tool 266 attached to a packer mandrel, such that when the housing 272 is displaced relative to the mandrel 278, the packer is set.

Valves 290, 292, 294 initially isolate each of the chambers 284, 286, 288, respectively, from communication with the chamber 238 of the container 232. Each of the chambers 284, 286, 288 is initially substantially filled with a fluid, such as oil. Thus, as the apparatus 264 is lowered within a well, hydrostatic pressure in the well acts to pressurize the fluid in the chambers 284, 286, 288. However, the fluid prevents each of the housings 272, 274, 276 from displacing substantially relative to its corresponding mandrel 278, 280, 282.

To actuate one of the tools 266, 268, 270, its associated valve 290, 292, 294 is opened, thereby permitting the fluid in the corresponding chamber 284, 286, 288 to flow into the chamber 238 of the container 232. As described above, the chamber 238 is substantially filled with a gas, such as air or Nitrogen at atmospheric or another relatively low pressure. Hydrostatic pressure in the well will displace the corresponding housing 272, 274, 276 relative to the corresponding mandrel 278, 280, 282, forcing the fluid in the corresponding chamber 284, 286, 288 to flow through the corresponding valve 290, 292, 294 and into the container 232. Such displacement may be readily stopped by closing the corresponding valve 290, 292, 294.

Operation of the valves 290, 292, 294 may be controlled by any of the methods described above. For example, the valves 290, 292, 294 may be connected to an electrical power source conveyed into the well on slickline, wireline or coiled tubing, a receiver may be utilized to receive a remotely transmitted signal whereupon the valves are connected to an electrical power source, such as a battery, downhole, etc. However, it is to be clearly understood that other methods of operating the valves 290, 292, 294 may be utilized without departing from the principles of the present invention.

The valve 290 may be a solenoid valve. The valve 292 may be a fusible plug-type valve (a valve openable by dissipation of a plug blocking fluid flow through a passage therein), such as that available from BEI. The valve 294 may be a valve/choke, such as the valve/choke 196 described above. Thus, it may be clearly seen that any type of valve may be used for each of the valves 290, 292, 294.

Figure 18:
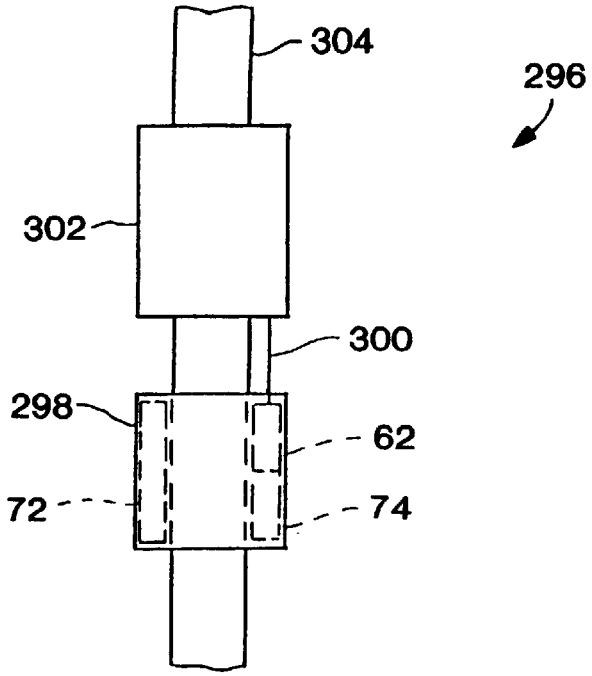
FIG. 18 is a schematicized elevational view of a seventh apparatus embodying principles of the present invention.

Referring additionally now to FIG. 18, another apparatus 296 embodying principles of the present invention is representatively illustrated. The apparatus 296 includes the receiver 72, battery 74 and pump 62 described above, combined in an individual actuator or hydraulic power source 298 connected via a line 300 to a tool or item of equipment 302, such as a packer, valve, choke, or other flow control device. The line 300 may be internally or externally provided, and the actuator 298 may be constructed with the tool 302, with no separation therebetween.

In FIG. 18, the apparatus 296 is depicted interconnected as a part of a tubular string 304 installed in a well. To operate the tool 302, a signal is transmitted from a remote location, such as the earth's surface or another location within the well, to the receiver 72. In response, the pump 62 is supplied electrical power from the battery 74, so that fluid at an elevated pressure is transmitted via the line 300 to the tool 302, for example, to set or unset a hydraulic packer, open or close a valve, vary a choke flow restriction, etc. Note that the representatively illustrated tool 302 is of the type which is responsive to fluid pressure applied thereto.

Figure 19:
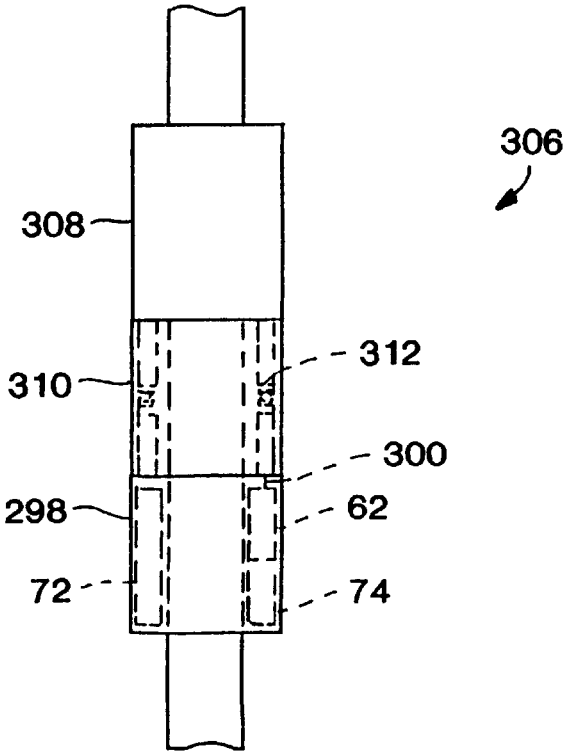
FIG. 19 is a schematicized elevational view of an eighth apparatus embodying principles of the present invention.

Referring additionally now to FIG. 19, an apparatus 306 embodying principles of the present invention is representatively illustrated. The apparatus 306 is similar in many respects to the apparatus 296 described above, however, a tool 308 of the apparatus 306 is of the type responsive to force applied thereto, such as a packer set by applying an axial force to a mandrel thereof, or a valve opened or closed by displacing a sleeve or other blocking member therein.

To operate the tool 308, a signal is transmitted from a remote location, such as the earth's surface or another location within the well, to the receiver 72. In response, the pump 62 is supplied electrical power from the battery 74, so that fluid at an elevated pressure is transmitted via the line 300 to a hydraulic cylinder 310 interconnected between the tool 308 and the actuator 298. The cylinder 310 includes a piston 312 therein which displaces in response to fluid pressure in the line 300. Such displacement of the piston 312 operates the tool 308, for example, displacing a mandrel of a packer, opening or closing a valve, varying a choke flow restriction, etc.

Thus have been described the methods 10, 50, 60, 70, 80, 90, 120, and apparatus and actuators 126, 172, 190, 214, 242, 264, 296, 306, which permit convenient and efficient control of fluid flow within a well, and operation of tools and items of equipment within the well. Of course, many modifications, additions, substitutions, deletions, and other changes may be made to the methods described above and their associated apparatus, which changes would be obvious to one of ordinary skill in the art, and these are contemplated by the principles of the present invention. For example, any of the methods may be utilized to control fluid injection, rather than production, within a well, each of the valves 168, 186, 196, 230, 256, 258, 260, 262, 290, 292, 294 may be other than a solenoid valve, such as a pilot-operated valve, and any of the actuators, pumps, control modules, receivers, packers, valves, etc. may be differently configured or interconnected, without departing from the principles of the present invention. Accordingly, the foregoing detailed description is to be clearly understood as being given by way of illustration and example only, the spirit and scope of the present invention being limited solely by the appended claims.

What is claimed is:

1. A method of controlling fluid flow within a subterranean wellbore, the method comprising the steps of:

providing a tubular string including a longitudinally spaced apart series of sealing devices, a pump, a control module interconnecting the pump to the sealing devices, and a receiver connected to the pump and control module;

positioning the tubular string within the wellbore;

transmitting a first signal to the receiver, thereby directing the control module to provide fluid communication between the pump and a selected at least one of the sealing devices;

transmitting a second signal to the receiver, thereby actuating the pump; and sealingly engaging the at least one of the sealing devices with the wellbore.

2. The method according to claim 1, wherein in the providing step, the tubular string further includes a power source connected to the receiver.

3. The method according to claim 2, wherein in the providing step, the power source is a battery.

4. The method according to claim 1, wherein the first signal transmitting step is performed via telemetry from a remote location.

5. A method of controlling fluid flow within a subterranean wellbore, the method comprising the steps of:

providing a tubular string including a longitudinally spaced apart series of sealing devices, a pump, a control module interconnecting the pump to the sealing devices, a receiver connected to the pump and control module, and a longitudinally spaced apart series of flow control devices;

positioning the tubular string within the wellbore;

transmitting a first signal to the receiver, thereby directing the control module to provide fluid communication between the pump and a selected at least one of the sealing devices;

transmitting a second signal to the receiver, thereby actuating the pump;

sealingly engaging the at least one Of the sealing devices with the wellbore; and transmitting a third signal to the receiver, thereby directing the control module to provide fluid communication between the pump and a selected at least one of the flow control devices.

6. A method of controlling fluid flow within a subterranean wellbore, the method comprising the steps of:

providing a tubular string including a longitudinally spaced apart series of sealing devices and an actuator in selectable fluid communication with each of the sealing devices;

positioning the tubular string within the wellbore;

selecting at least one of the sealing devices for actuation; and transmitting a first signal to the actuator, thereby actuating the selected at least one Of the sealing devices to sealingly engage the wellbore.

7. The method according to claim 6, wherein the selecting step is performed by transmitting a second signal to a control module of the actuator.

8. The method according to claim 6, wherein the transmitting step further comprises transmitting the first signal from a remote location to a receiver of the actuator.

9. The method according to claim 6, wherein in the providing step, the actuator includes a power source and a pump, and wherein the transmitting step further comprises actuating the selected at least one of the sealing devices by pumping fluid to the selected at least one of the sealing devices.

10. The method according to claim 6, wherein in the providing step, the actuator includes an impeller operatively connected to a pump, and wherein the transmitting step further comprises flowing fluid over the impeller, thereby causing the pump to deliver fluid to the selected at least one of the sealing devices.

11. The method according to claim 6, wherein in the providing step, the actuator further includes a control module, and further comprising the step Of transmitting a second signal to the actuator, thereby causing the control module to provide fluid communication between the pump and the selected at least one of the sealing devices.

12. An apparatus for controlling fluid flow within a subterranean well, the apparatus comprising:

a series of longitudinally spaced apart sealing devices;

a series Of longitudinally spaced apart flow control devices, the flow control devices and sealing devices being interconnected in a tubular string in which the flow control devices are alternated with the sealing devices; and an actuator interconnected to each of the sealing devices and to each of the flow control devices and independently actuating each of the sealing devices.

* * * * *